US010232393B2

(12) United States Patent
Dumont et al.

(10) Patent No.: US 10,232,393 B2
(45) Date of Patent: Mar. 19, 2019

(54) SYSTEM FOR ACTUATING A MEMBER FOR DISPENSING A FLUID PRODUCT

(71) Applicant: ALBEA LE TREPORT, Le Treport (FR)

(72) Inventors: Pierre Dumont, Dargnies (FR); Frederic Leleu, Le Treport (FR); Herve Lompech, Ansennes Bouttencourt (FR); Eric Rossignol, Chalon sur Saone (FR); Jacky Lasnier, Sainte Marguerite sur Duclair (FR)

(73) Assignee: ALBEA LE TREPORT, Le Treport (FR)

( * ) Notice: Subject to any disclaimer, the term of this patent is extended or adjusted under 35 U.S.C. 154(b) by 131 days.

(21) Appl. No.: 14/964,755

(22) Filed: Dec. 10, 2015

(65) Prior Publication Data

US 2016/0175865 A1 Jun. 23, 2016

(30) Foreign Application Priority Data

Dec. 19, 2014 (FR) ..... 14 62955

(51) Int. Cl.
*B05B 11/00* (2006.01)

(52) U.S. Cl.
CPC ..... *B05B 11/0027* (2013.01); *B05B 11/3052* (2013.01); *B05B 11/3059* (2013.01); *B05B 11/3049* (2013.01)

(58) Field of Classification Search
CPC ..... B05B 1/0027
USPC ..... 222/153.13
See application file for complete search history.

(56) References Cited

U.S. PATENT DOCUMENTS

| | | | | |
|---|---|---|---|---|
| 3,797,705 | A | 3/1974 | Cooprider | |
| 3,827,606 | A * | 8/1974 | Knickerbocker | B05B 11/3059 222/153.13 |
| 4,024,988 | A | 5/1977 | Starrett | |
| 4,343,417 | A | 8/1982 | Corsette | |
| 4,865,228 | A * | 9/1989 | Landecker | B05B 11/0027 222/153.13 |
| 2014/0097207 | A1* | 4/2014 | Szymiczek | B05B 11/0032 222/153.13 |

(Continued)

OTHER PUBLICATIONS

France App No. 1462955, International Search Report, dated Jul. 3, 2015.

*Primary Examiner* — Jeremy Carroll
(74) *Attorney, Agent, or Firm* — Banner & Witcoff, Ltd.

(57) ABSTRACT

A system for actuating a member for dispensing a fluid product has a push button and a body having a well for mounting on a tube for supplying the member. The push button is axially movable over an actuating course of the member. A locking device reversibly locks the actuation by preventing movement. The locking device has an insert mounted in the bushing with the option of relative rotation, the insert having means for connecting to the member for conjoint rotation and at least one deformable stop. The locking device has a structure connected to the bushing for conjoint rotation and is arranged, by rotating the bushing relative to the insert, to deform the stop between an active state in which said stop is arranged on the actuating course to interfere with the body and an inactive state in which said stop is at a distance from the course.

16 Claims, 4 Drawing Sheets

(56) References Cited

U.S. PATENT DOCUMENTS

2015/0367367 A1* 12/2015 Lefevre ..... B65D 50/065
222/153.13

* cited by examiner

SYSTEM FOR ACTUATING A MEMBER FOR DISPENSING A FLUID PRODUCT

CROSS REFERENCE TO RELATED APPLICATIONS

This application claims priority to French Application Serial No. 1462955, filed Dec. 19, 2014, which is hereby incorporated by reference in its entirety.

FIELD

The invention relates to a system for actuating a member for dispensing a fluid product, to a dispensing member equipped with such an actuating system and to a bottle to which such a member is attached.

In a particular application, the fluid product has a cosmetic use or is used for pharmaceutical treatments, in particular in the form of liquid, gel or cream.

BACKGROUND

Dispensing members are known, for example formed by a pump, which comprise an actuating push button of which the body has a well for mounting on a tube for the pressurised supply of the product, and a path for dispensing said product as far as a discharge passage.

Therefore, by pressing the body of the push button, the tube is actuated to move over a dispensing/suction course of the product by the pump, in order to be able to retrieve the product through the discharge passage in a small amount or as a continuous stream.

For aesthetic and/or functional reasons relating to the attachment thereof, the dispensing members are conventionally equipped with a bushing in which the push button is axially movable over the actuating course of the dispensing member.

Moreover, in order to prevent the dispensing member from being involuntarily actuated by the push button being accidentally pressed, it is known to equip said member with a cap that covers said push button between two uses. It is also proposed to equip the dispensing members with a device for reversibly locking the actuation thereof by preventing the movement of the push button over its actuating course. However, the implementations according to the prior art are proving complex, in particular in terms of handling.

SUMMARY

The invention aims to improve upon the prior art by proposing in particular a system for actuating a member for dispensing a fluid product that is equipped with a device for reversibly locking the actuation which is simple to produce and handle, while producing reliable locking of the actuation of the member between two uses.

For this purpose, and according to a first aspect, the invention proposes a system for actuating a member for dispensing a fluid product, said system comprising a push button of which the body has a well for mounting on a tube for supplying said member and a path for dispensing said product as far as a discharge passage, said system comprising a bushing in which said push button is axially movable over an actuating course of the dispensing member and a device for reversibly locking said actuation by preventing said movement, the locking device comprising an insert which is mounted in the bushing with the option of relative rotation, said insert having means for connecting to the dispensing member for conjoint rotation and at least one deformable stop, said locking device further comprising a structure which is connected to the bushing for conjoint rotation, said structure being arranged, by rotating said bushing relative to the insert, to deform the stop between an active state in which said stop is arranged on the actuating course to interfere with the body, preventing actuation, and an inactive state in which said stop is at a distance from said course to allow actuation.

According to a second aspect, the invention proposes a dispensing member comprising a tube for the pressurised supply of a fluid product, said member being equipped with such an actuating system, wherein the well is mounted on said tube in order to supply the dispensing path, said member being equipped with a system for attachment to a container in which the fluid product is packaged.

According to a third aspect, the invention proposes a dispensing bottle having a container for packaging a fluid product, said container having a neck mounted thereon, to which the system for attaching such a dispensing member is attached, allowing said member to be supplied with packaged product.

Other objects and advantages of the invention will become apparent in the following description, given with reference to the accompanying drawings, in which:

DETAILED DESCRIPTION

Figure 1:
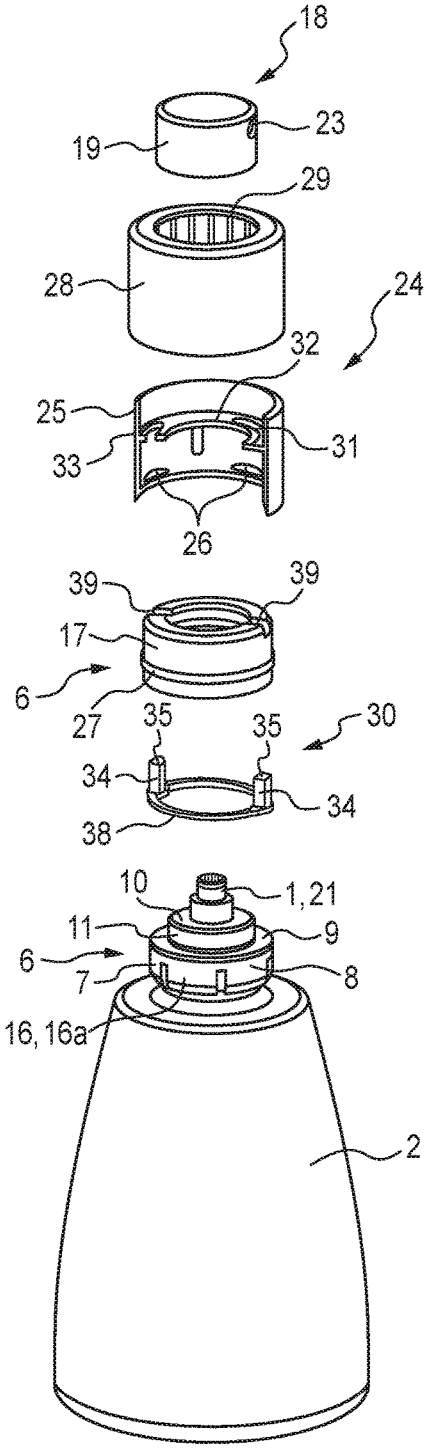
FIGS. 1 and 2 show a dispensing bottle according to a first and a second embodiment of the invention, respectively.

In the description, the terms relating to positioning in space are understood with reference to the position of the bottle shown in the drawings.

With reference to the drawings, the following are described below: a system for actuating a member 1 for dispensing a fluid product, a dispensing member 1 equipped with such an actuating system and a bottle intended to contain a fluid product and on which such a member 1 is mounted with a view to dispensing said fluid product. In particular examples, the product may be a liquid, a gel or a cream, for a cosmetic use or for pharmaceutical treatments.

The bottle may be made of rigid material, in particular of glass or plastics material, in order to comprise a body 2 which defines a container 3 for packaging the product. The body 2 has a neck 4 mounted thereon which is formed in one piece with said body. The dispensing bottle also comprises a dispensing member 1 that is mounted on the neck 4, providing the means 5 for supplying said member inside the container 3, in order to allow said member to be supplied with packaged product.

In the embodiments shown, the dispensing member 1 comprises a pump which has a body of which the periphery is mounted in the neck 4 without clamping. The body has a lower part which is provided with a supply opening, the supply means 5 comprising a dip tube having an upper part that is fixed in the opening and a lower part that extends in the container 3.

The dispensing member further comprises a system for allowing it to be attached to the neck 4 of the bottle, said system having a socket 6 that is intended to be attached to said neck in a sealed manner. In the embodiments shown, the attachment socket 6 comprises a frame 7 which has an outer envelope of revolution, the dispensing member 1 being rigidly connected to said frame within said envelope.

With reference to the drawings, the frame 7 comprises an annular bearing surface 8 on which the outer envelope is formed, and a radial wall 9 which is mounted on top of said annular bearing surface. Furthermore, the frame 7 comprises an upper wall 10 which is provided with an opening in which the dispensing member 1 is mounted, said upper wall being connected to the radial wall 9 by means of a wall 11. Moreover, in order to ensure that the frame 7 is rigidly connected to the dispensing member 1, the wall 11 comprises a recess 12 for latching with a groove 13 that is formed on the body of said dispensing member.

In the embodiments shown, the dispensing member 1 is attached to the neck 4 by interposing an annular seal 14 between the upper wall of the neck 4 and the radial wall 9 of the frame 7, said upper wall further comprising a sealing band 15. In a variant, the body of the dispensing member 1 may be clamped in sealed manner in the neck 4 such that it is possible to omit the seal.

The frame 7 also comprises a skirt 16 which has a mounting configuration (FIGS. 1 and 2) in which said skirt can be positioned around an outer side wall of the neck 4 and a clamping configuration (FIG. 3-6) of said skirt around said side wall to ensure attachment.

In the embodiments shown, the skirt 16 has tabs 16*a* that are arranged to latch under the outer side wall of the neck 4 in the mounting configuration. In a variant, the skirt 16 may have tabs 16*a* which can be folded radially from the mounting configuration into the clamping configuration.

Moreover, the socket 6 comprises a flange 17 that is mounted around the outer envelope of the frame 7 so as to slide between a raised position and a lowered position. Therefore, the tabs 16 of the skirt 16 may be kept in the clamping configuration as the flange 17 is being moved into the lowered position.

The dispensing member 1 further comprises an actuating system for allowing the fluid product to be dispensed, said system comprising a push button 18 of which the body 19 has a well 20 for mounting on a tube 21 for supplying said member 1 and a path 22 for dispensing said product as far as a discharge passage 23 that is formed in said push button.

The actuating system further comprises a bushing 24, in which the push button 18 is axially movable over an actuating course of the dispensing member 1. In the embodiments shown, the bushing 24 comprises a cylindrical coupling 25 which is axially immobilised on the socket 6 with the option of rotation.

In order to do this, the cylindrical coupling 25 has a cylindrical envelope which defines an upper cavity in which the push button 18 is axially movable, and a lower cavity for receiving the socket 6. In particular, the envelope comprises at least one projection 26 which extends radially from the lower wall thereof and close to the bottom of the lower cavity, said projection latching under an annular bead 27 that is formed on the flange 17 in order to allow the cylindrical coupling 25 to be axially immobilised on said flange with the option of rotation.

The bushing 24 further comprises an outer collar 28 which is connected around the cylindrical coupling 25 for conjoint rotation, it being possible to produce said collar in one piece, in particular from a rigid material such as metal, and for example from aluminium, or from plastics material.

In particular, the inner wall of the collar 28 is provided with ridges 29 which become embedded in the outer wall of the envelope of the cylindrical coupling 25 in order to allow said collar to be connected to said cylindrical coupling for conjoint rotation. In order to do this, in an optimal manner, the material of the collar 28 may have a hardness that is greater than that of the cylindrical coupling 25.

In order to prevent the dispensing member 1 from being involuntarily actuated by the push button 18 being accidentally pressed, the actuating system further comprises a device for reversibly locking said actuation by preventing the axial movement of said push button.

The locking device comprises an insert 30 which is mounted in the cylindrical coupling 25 of the bushing 24 with the option of relative rotation. The insert 30 has connection means for conjoint rotation that are engaged with the socket 6 of the dispensing member 1, and at least one deformable stop that is intended to interfere with the body 19 of the push button 18 in order to prevent the dispensing member 1 from being actuated.

In particular, the insert 30 is arranged in the upper cavity in the cylindrical coupling 25, such that the lower end of the body 19 of the push button 18 comes into axial interference with the deformable stop in order to prevent the dispensing member 1 from being actuated.

The locking device further comprises a structure that is connected to the bushing 24 for conjoint rotation, and in particular is formed inside the cylindrical coupling 25, said structure being arranged, by rotating the bushing 24 relative to the insert 30, to deform the stop between an active state in which said stop is arranged on the actuating course of the dispensing member 1 to interfere with the body 19 of the push button 18, preventing said actuation, and an inactive state in which said stop is at a distance from said course to allow actuation.

In order to do this, the structure has a circumferential ramp 31 on which the stop is arranged, said ramp extending angularly between a minimum radial dimension for arranging the stop in one state and a maximum radial dimension for arranging the stop in the other state.

Figure 3A:
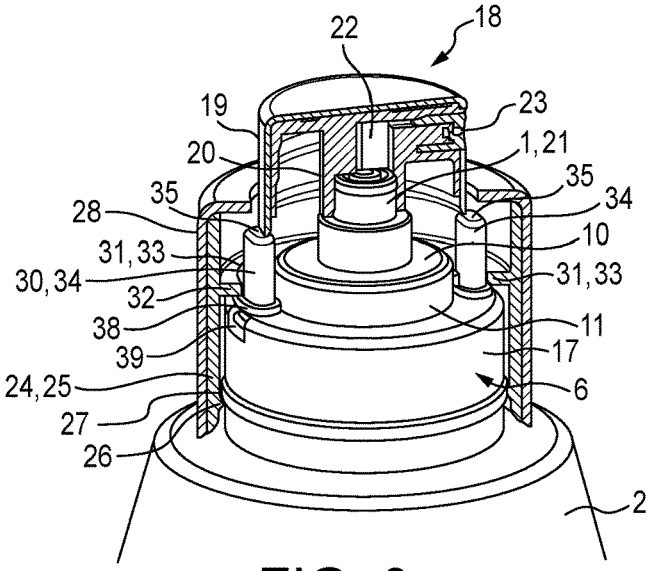
FIGS. 3*a* and 3*b* are partial longitudinal sectional side views and FIG. 3*c* is a partial plan view of a cross section of the bottle according to the first embodiment, in which the device for locking the actuation of the actuating system is in an active state.
Figure 3B:
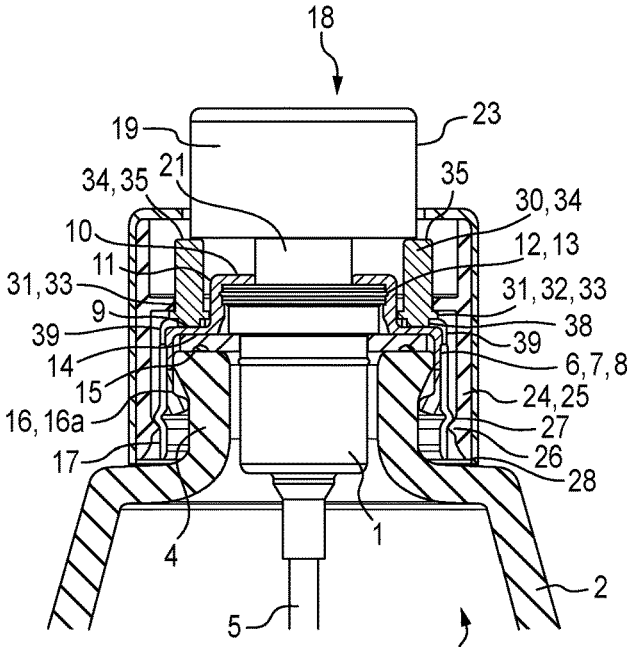
Figure 3C:
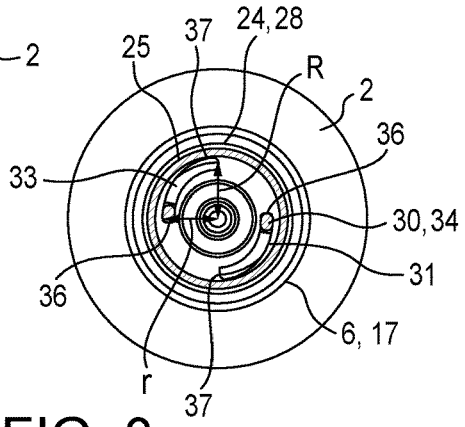
Figure 4A:
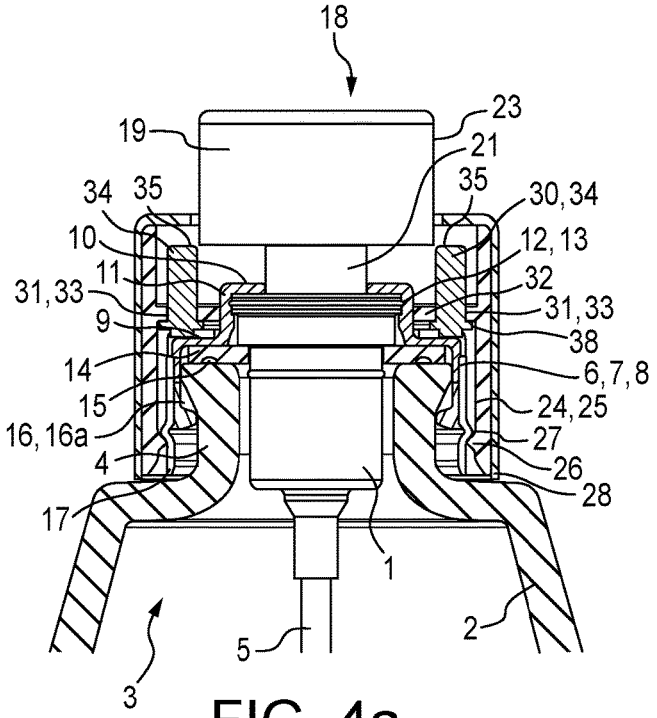
FIG. 4*a* is a partial longitudinal sectional side view and FIG. 4*b* is a partial plan view of a cross section of the bottle according to the first embodiment, in which the device for locking the actuation of the actuating system is in an inactive state.

With reference to FIGS. 1, 3 and 4, a first embodiment is described below in which the cylindrical coupling 25 has an inner plate 32 which extends between the lower and upper cavities, and on which the circumferential ramp 31 is formed. In particular, the inner plate 32 comprises an aperture 33 in a side wall from which the circumferential ramp is formed, and the stop comprises a finger 34 which is engaged in said aperture.

In the above-mentioned figures, the inner plate 32 and the stop each comprise two apertures 33 and two fingers 34 which are distributed symmetrically relative to a longitudinal plane, each finger 34 being engaged in one aperture 33 in each case and comprising a distal end 35 with which the lower end of the body 19 of the push button 18 comes into axial interference when said fingers are in the active state. Therefore, the blocking of the push button 18 in a raised position is axially balanced in order to prevent the dispensing member 1 from being actuated.

Figure 4B:
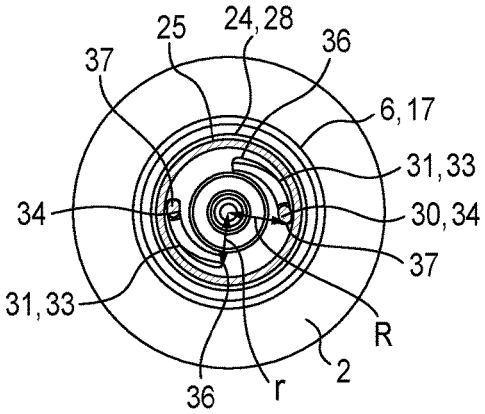

With reference to FIGS. 3*c* and 4*b*, each aperture 33 has a first end 36 which extends, according to a minimum radial dimension r, relative to the centre of the upper cavity and a second end 37 which extends, according to a maximum radial dimension R, relative to said centre, the ramp 31 extending angularly between said ends, having a radial dimension that varies continuously between said minimum and maximum radial dimensions. Therefore, during rotation of the bushing 24, each ramp 31 slides on the side of a finger 34 in order to progressively deform said finger, and therefore said stop, between the active and inactive states thereof.

Moreover, each end 36, 37 of an aperture 33 is arranged so that the finger 34 abuts said aperture at the end of the angular course of the bushing 24, in order to define the active state and the inactive state of the deformable stop, respectively.

In particular, the fingers 34 form means for connecting the insert 30 to the dispensing member 1 for conjoint rotation. In order to do this, the insert 30 has a ring 38, on which the fingers 34 extend axially, said ring being mounted in the socket 6 so as to be interposed between the flange 17 and the wall 9 of the frame 7. Moreover, the flange 17 has two openings 39 that are distributed symmetrically relative to a longitudinal plane, a finger 34 being angularly immobilised in one of said openings respectively.

Figure 2:
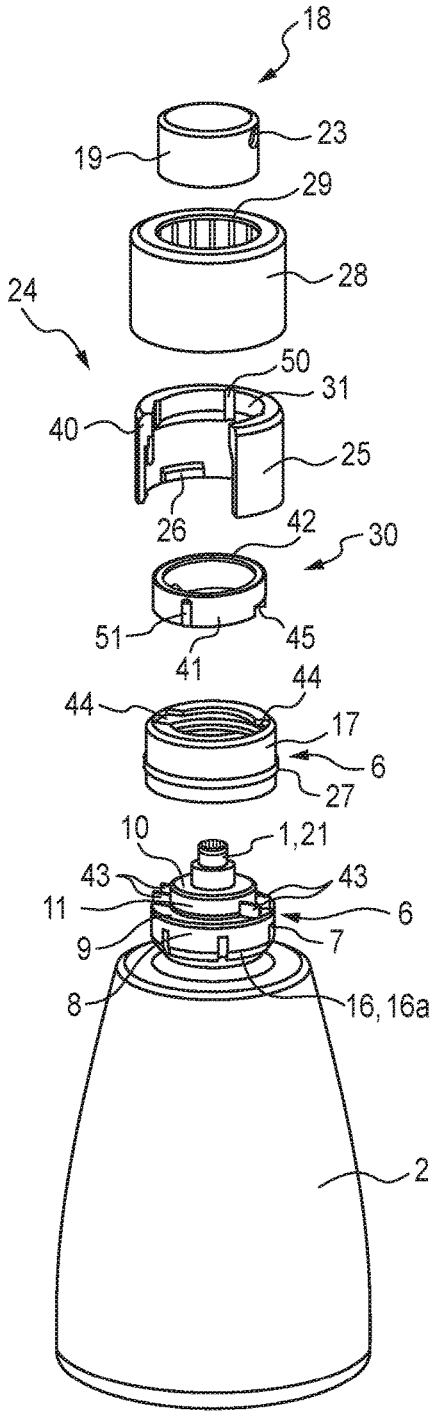
Figure 5A:
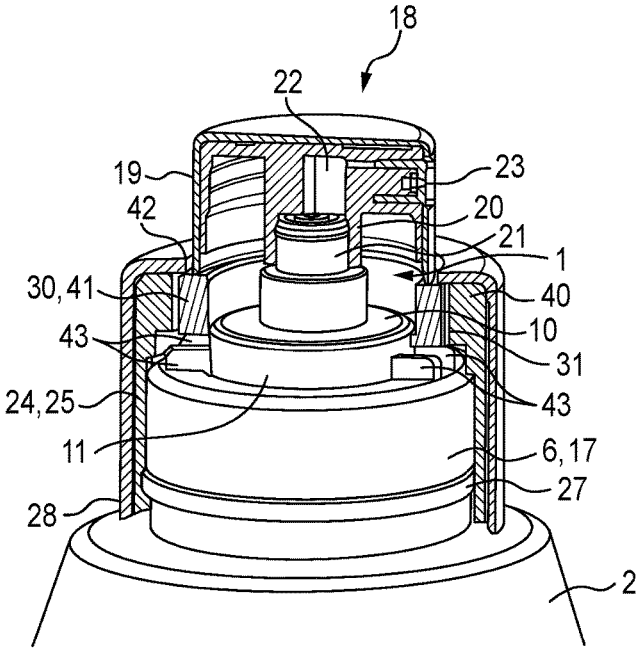
FIGS. 5*a* and 5*b* are partial longitudinal sectional side views and FIG. 5*c* is a partial plan view of a cross section of the bottle according to the second embodiment, in which the device for locking the actuation of the actuating system is in an active state.
Figure 5B:
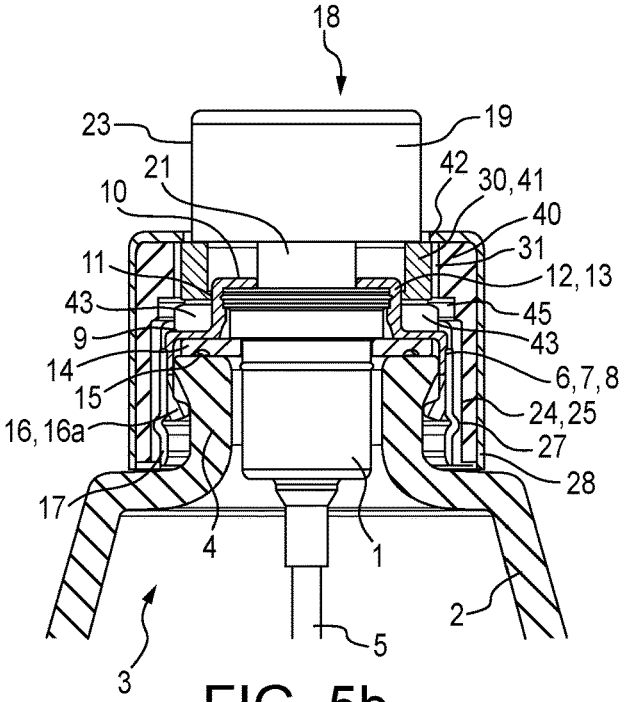

With reference to FIGS. 2, 5 and 6, a second embodiment is described below in which the bushing 24 has a rim 40, on the inside of which the circumferential ramp 31 is formed. In particular, the envelope of the cylindrical coupling 25 comprises an upper portion on which the rim 40 is formed, the circumferential ramp 31 being formed on the inner wall of said rim so as to extend in the upper part of the upper cavity.

Moreover, the insert 30 has a deformable ring 41 which is mounted in the rim 40 and has an upper wall 42, with which the lower end of the body 19 of the push button 18 comes into axial interference when the stop is in the active state.

In particular, the fact that the upper wall 42 extends circumferentially and continuously around a longitudinal axis allows the blocking of the push button 18 in a raised position to be axially balanced, in order to prevent the dispensing member 1 from being actuated.

In order to ensure that the ring 41 is connected to the dispensing member 1 for conjoint rotation, the socket 6 comprises at least one projection 43 on which said ring is angularly immobilised.

More specifically, the frame 7 comprises four projections 43 that are formed on the wall 9 and are distributed symmetrically in pairs relative to a longitudinal plane, the flange 17 having two openings 44, in each of which a pair of projections 43 is arranged so as to extend axially. Moreover, the ring 41 comprises two lower cutouts 45 which are distributed symmetrically relative to a longitudinal plane, and in each of which a pair of projections 43 is intended to be arranged in order to angularly immobilise said ring.

Figure 5C:
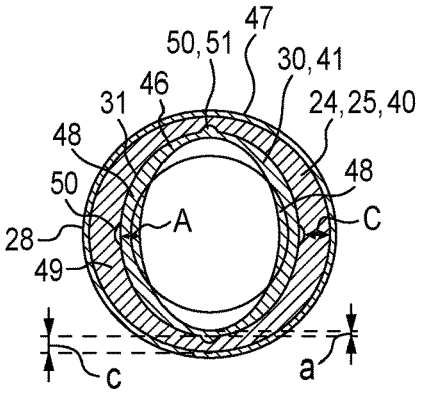
Figure 6A:
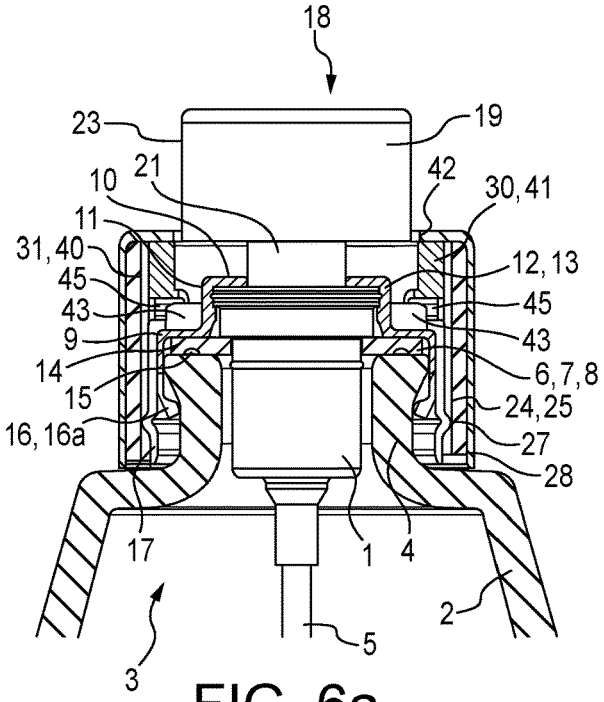
FIG. 6*a* is a partial longitudinal sectional side view and FIG. 6*b* is a partial plan view of a cross section of the bottle according to the second embodiment, in which the device for locking the actuation of the actuating system is in an inactive state.
Figure 6B:
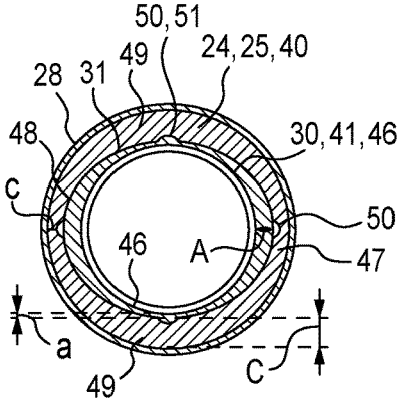

As shown in particular in FIGS. 5*c* and 6*b*, the ring 41 has two radial dimensions that are minimum and maximum respectively, said dimensions being arranged together with the dimensions of the ramp 31 so that said ring interferes with the body 19 of the push button 18 when the maximum dimensions of said ramp and said ring are arranged opposite each other (FIGS. 5*b* and 5*c*), and so that said ring does not interfere with said body when a maximum dimension and a minimum dimension of said ring and said ramp are arranged opposite each other (FIGS. 6*a* and 6*b*).

In order to do this, the ring 41 and the rim 40 each have an elliptical geometry which, by a relative offset of 90°, successively form a substantially cylindrical hole in the inactive state (FIG. 6*b*) and a substantially elliptical hole in the active state (FIG. 5*c*).

More specifically, the ring 41 and the rim 40 each have two wall portions 46, 47 having a minimum radial thickness a, c and two wall portions 48, 49 having a maximum radial thickness A, C, the wall portions 46, 48, 47, 49 having the same radial thickness a, A, c, C being arranged opposite one another in pairs.

Therefore, when the thickest wall portions 47, 49 of the rim 40 and of the ring 41, therefore the respective maximum radial thicknesses A, C, are arranged opposite one another in pairs, the ring 41 is deformed so as to form an elliptical hole, of which the small diameter forms a minimum radial dimension allowing the thickest wall portions 47 of the stop to interfere with the body 19 of the push button 18.

Similarly, when the thickest wall portions 47, 49, therefore the maximum radial thicknesses A, C, of one of the rim 40 and the ring 41 are arranged opposite the thinnest wall portions 46, 48, therefore the minimum radial thicknesses a, c, of the other of said ring and said rim, the ring 41 is deformed so as to form a cylindrical hole, of which the diameter forms a maximum radial dimension allowing the wall portions 46, 47 of the stop to be at a distance from the actuating course of the push button 18.

Advantageously, this second embodiment makes it possible to activate or deactivate the locking device independently of the direction of rotation of the bushing 24, and this facilitates said activation and hence the use of the bottle.

Moreover, the rim 40 and the ring 41 have a relative-rotation interface which is provided with means for indexing the state of the ring 41.

With reference to the drawings, the rim 40 comprises four axial recesses 50 which are formed on the circumferential ramp 31 so as to be spaced apart in pairs by an angle of 90°. Similarly, the ring 41 comprises two axial projections 51 which are formed on an outer wall of said ring so as to be spaced apart in pairs by an angle of 180°, said projections being intended to be engaged in two diametrically opposed recesses 50 in order to arrange said ring in one or the other of its states.

Therefore, to move the ring 41 from one state to another, it is sufficient to turn the bushing 24 over an angular course of 90°, first to remove the projections 51 from the recesses 50 defining the first state and then until said projections are engaged in the recesses 50 defining the second state.

Moreover, the projections 51 and/or the recesses 50 may be arranged so that arranging said projections in two of said recesses is accompanied by a characteristic clipping sound in order to indicate to the user of the bottle that the locking device has been correctly activated or deactivated.

The invention claimed is:

1. System for actuating a member for dispensing a fluid product, said system comprising a push button having a body, the body having a well for mounting on a tube for supplying said member and a path for dispensing said product as far as a discharge passage, said system further comprising a bushing in which said push button is axially movable over an actuating course of the dispensing member and a locking device for reversibly locking said actuation by preventing said movement, wherein the locking device comprises an insert mounted in the bushing, said insert having means for connecting to the dispensing member for conjoint rotation and at least one deformable stop, said locking device further comprising a structure connected to the bushing for conjoint rotation, said structure being arranged, by rotating said bushing relative to the insert to deform the deformable stop between an active state in which said stop is arranged on the actuating course to interfere with the body, preventing actuation, and an inactive state in which said stop is at a distance from said course to allow actuation, wherein the structure has a circumferential ramp on which the deformable stop is arranged, said circumferential ramp extending angularly between a minimum radial dimension (r, c) for arranging the deformable stop in one of the active state and the inactive state and a maximum radial dimension (R, C) for arranging the deformable stop in the inactive state, wherein the stop comprises a finger that is engaged in an aperture in the structure, the ramp being formed by a side wall of said aperture, said aperture having a first end extending at the minimum radial dimension and a second end extending at the maximum radial dimension, each end being arranged so that said finger abuts said aperture at the end of an angular course of said bushing in order to define said active state and said inactive state.

2. Actuating system according to claim 1, wherein the bushing has an outer collar connected around a cylindrical coupling for conjoint rotation, in which coupling the insert is rotationally mounted, the structure being formed inside said cylindrical coupling.

3. Actuating system according to claim 2, wherein the cylindrical coupling has an inner plate on which the circumferential ramp is formed.

4. Actuating system according to claim 1, wherein the finger has a distal end with which the body comes into axial interference when said finger is in the active state.

5. Actuating system according to claim 1, wherein the insert has a ring on which at least one finger extends axially.

6. Actuating system according to claim 1, wherein the finger forms means for connecting the insert to the dispensing member.

7. Dispensing member, comprising a tube for the pressurised supply of a fluid product, said dispensing member being equipped with an actuating system according to claim 6, wherein the well is mounted on said tube in order to supply the dispensing path, said dispensing member being equipped with a system for attachment to a container in which the fluid product is packaged, wherein the attachment system has a socket that is intended to be attached to the container in a sealed manner, the bushing being axially immobilised on said socket, means for connecting the insert for conjoint rotation being engaged with said socket; and wherein one of the fingers is angularly immobilised relative to the socket.

8. Actuating system according to claim 1, wherein the bushing has a rim on the inside of which the circumferential ramp is formed.

9. Actuating system according to claim 8, wherein the insert has a deformable ring which is mounted in the rim, said ring having an upper wall with which the body comes into axial interference when the deformable stop is in the active state.

10. Actuating system according to claim 9, wherein the ring has two radial dimensions that are minimum (a) and maximum (A) respectively, said dimensions being arranged together with the dimensions (c, C) of the ramp so that said ring interferes with the body when the maximum dimensions (A, C) are arranged opposite each other, and does not interfere with said body when a minimum dimension (a, c) and a maximum dimension (A, C) are arranged opposite each other.

11. Actuating system according to claim 10, wherein the ring and the rim each have an elliptical geometry which, by a relative offset of 90°, successively form a substantially cylindrical hole in the inactive state and a substantially elliptical hole in the active state.

12. Actuating system according to claim 9, wherein the rim and the ring have a relative-rotation interface which is provided with means for indexing the state of the ring.

13. Dispensing member, comprising a tube, the tube providing pressurised supply of a fluid product, said dispensing member being equipped with the actuating system according to claim 1, wherein the well is mounted on said tube in order to supply the dispensing path, said member being equipped with a system for attachment to a container in which the fluid product is packaged.

14. Dispensing bottle having a container for packaging the fluid product, said container having a neck mounted thereon, to which the system for attaching the dispensing member according to claim 13 is attached, allowing said dispensing member to be supplied with packaged product.

15. Dispensing member according to claim 13, wherein the attachment system has a socket that is intended to be attached to the container in a sealed manner, the bushing being axially immobilised on said socket, the insert means for connecting to the dispensing member for conjoint rotation being engaged with said socket.

16. Dispensing member, comprising a tube for the pressurised supply of a fluid product, said member being equipped with an actuating system according to claim 9, wherein the well is mounted on said tube in order to supply the dispensing path, said member being equipped with a system for attachment to a container in which the fluid product is packaged, wherein the attachment system has a socket that is intended to be attached to the container in a sealed manner, the bushing being axially immobilised on said socket, the means for connecting the insert for conjoint rotation being engaged with said socket; and the socket comprises at least one projection on which the ring is angularly immobilised.

* * * * *